US006036729A

United States Patent [19]

Barfoed et al.

[11] Patent Number: 6,036,729

[45] Date of Patent: Mar. 14, 2000

[54] ENZYMATIC METHOD FOR TEXTILE DYEING

[75] Inventors: Martin Barfoed, Raleigh, N.C.; Ole Kirk, Virum, Denmark

[73] Assignees: Novo Nordisk A/S, Bagsværd, Denmark; Novo Nordisk Biochem North America, Inc., Franklinton, N.C.

[21] Appl. No.: 08/770,760

[22] Filed: Dec. 19, 1996

Related U.S. Application Data

[60] Provisional application No. 60/016,729, May 2, 1996, and provisional application No. 60/009,198, Dec. 22, 1995.

[51] Int. Cl.[7] ..... D06P 1/32

[52] U.S. Cl. ..... 8/401; 8/404; 8/405; 8/406; 8/416; 8/421; 8/423; 8/424; 8/436; 8/916; 8/917; 8/552; 8/649; 435/263

[58] Field of Search ..... 8/401, 404, 405, 8/406, 416, 421, 423, 424, 436, 552, 916, 917, 649; 435/263

[56] References Cited

U.S. PATENT DOCUMENTS

| | | | |
|---|---|---|---|
| 3,251,742 | 5/1966 | Soloway | 8/401 |
| 5,178,637 | 1/1993 | Lagrange et al. | 8/406 |
| 5,239,202 | 8/1993 | Peck | 8/401 |
| 5,538,517 | 7/1996 | Samain et al. | 8/423 |
| 5,667,531 | 9/1997 | Yaver et al. | 8/401 |
| 5,849,041 | 12/1998 | Kunz et al. | 8/401 |
| 5,925,148 | 7/1999 | Barfoed et al. | 8/401 |

FOREIGN PATENT DOCUMENTS

| | | |
|---|---|---|
| 0 431 682 | 6/1991 | European Pat. Off. . |
| 504005 | 9/1992 | European Pat. Off. . |
| 2112549 | 6/1972 | France . |
| WO 92/18683 | 10/1992 | WIPO . |
| WO 94/00100 | 1/1994 | WIPO . |
| WO 95/33836 | 12/1995 | WIPO . |

OTHER PUBLICATIONS

Derwent Publication Ltd., 90–161489 (Apr. 17, 1990).
Derwent Publicaton Ltd., 91–143144 (Apr. 3, 1991).
Derwent Publication Ltd., 95–033019 (Nov. 15, 1994).
Derwent Publication Ltd., 96–295885 (May 21, 1996).

*Primary Examiner*—Alan Diamond
*Attorney, Agent, or Firm*—Steve T. Zelson, Esq.; Reza Green, Esq.

[57] ABSTRACT

The present invention relates to methods of dyeing a material, comprising (a) soaking the material in an aqueous solution which comprises one or more mono-, di- or polycyclic aromatic or heteroaromatic compounds; and (b) treating the soaked material in an aqueous solution with (i) a hydrogen peroxide source and an enzyme exhibiting peroxidase activity or (ii) an enzyme exibiting oxidase activity on the one or more aromatic or heteroaromatic compounds; wherein the material is a fabric, yarn, fiber, garment or film made of fur, hide, leather, silk or wool.

14 Claims, No Drawings

ENZYMATIC METHOD FOR TEXTILE DYEING

CROSS-REFERENCE TO RELATED APPLICATIONS

This application claims the benefit of provisional application Ser. No. 60/016,729 filed May 2, 1996 and provisional application Ser. No. 60/009,198 filed Dec. 22, 1995, which are incorporated herein by reference.

FIELD OF THE INVENTION

The present invention relates to methods of dyeing a material, comprising (a) soaking the material in an aqueous solution which comprises one or more mono-, di- or polycyclic aromatic or heteroaromatic compounds; and (b) treating the soaked material in an aqueous solution with (i) a hydrogen peroxide source and an enzyme exhibiting peroxidase activity or (ii) an enzyme exibiting oxidase activity on the one or more aromatic or heteroaromatic compounds; wherein the material is a fabric, yarn, fiber, garment or film made of fur, hide, leather, silk or wool.

BACKGROUND OF THE INVENTION

Dyeing of textiles is often considered to be the most important and expensive single step in the manufacturing of textile fabrics and garments. In the textile industry, two major types of processes are currently used for dyeing, i.e., batch and continuous. In the batch process, among others, jets, drums, and vat dyers are used. In continuous processes, among others, padding systems are used. See, e.g., I. D. Rattee, In C. M. Carr (Ed.), "The Chemistry of the Textiles Industry," Blackie Academic and Professional, Glasgow, 1995, p. 276.

The major classes of dyes are azo (mono-, di-, tri-, etc.), carbonyl (anthraquinone and indigo derivatives), cyanine, di- and triphenylmethane and phthalocyanine. All these dyes contain chromophoric groups which give rise to color. There are three types of dyes involving an oxidation/reduction mechanism, i.e., vat, sulfur and azoic dyes. The purpose of the oxidation/reduction step in these dyeings are to change the dyestuff between an insoluble and a soluble form.

Oxidoreductases, e.g., oxidases and peroxidases, are well known in the art.

One class of oxidoreductases is laccases (benzenediol:oxygen oxidoreductases) which are multicopper containing enzymes that catalyze the oxidation of phenols and related compounds. Laccase-mediated oxidation results in the production of aromatic radical intermediates from suitable substrates; the ultimate coupling of the intermediates so produced provides a combination of dimeric, oligomeric, and polymeric reaction products. Such reactions are important in nature in biosynthetic pathways which lead to the formation of melanin, alkaloids, toxins, lignins, and humic acids.

Another class of oxidoreductases are peroxidases which oxidize compounds in the presence of hydrogen peroxide.

Laccases have been found to be useful for hair dyeing. See, e.g., PCT applications Ser. No. PCT/US95/06815 and PCT/US95/06816. European Patent No. 0504005 discloses that laccases can be used for dyeing wool at a pH in the range of between 6.5 and 8.0.

Saunders et al., Peroxidase, London, 1964, p. 10 ff. disclose that peroxidases act on various amino and phenolic compounds resulting in the production of a color.

Japanese Patent Application publication no. 6-316874 discloses a method for dyeing cotton comprising treating the cotton with an oxygen-containing medium, wherein an oxidation reduction enzyme selected from the group consisting of ascorbate oxidase, bilirubin oxidase, catalase, laccase, peroxidase, and polyphenol oxidase is used to generate the oxygen.

WO 91/05839 discloses that oxidases and peroxidases are useful for inhibiting the transfer of textile dyes.

It is an object of the present invention to provide an enzymatic method of dyeing textile fabrics.

SUMMARY OF THE INVENTION

The present invention relates to method of dyeing a material, comprising (a) soaking the material in an aqueous solution which comprises one or more mono-, di- or polycyclic aromatic or heteroaromatic compounds, each of which is optionally substituted with one or more functional groups or substituents, wherein each functional group or substituent is selected from the group consisting of halogen; sulfo; sulfonato; sulfamino; sulfanyl; amino; amido; nitro; azo; imino; carboxy; cyano; formyl: hydroxy; balocarbonyl; carbamoyl; carbamidoyl; phosphonato; phosphonyl; $C_{1-18}$-alkyl; $C_2$–$C_{18}$-alkenyl; $C_2$–$C_{18}$-alkynyl; $C_{1-18}$-alkoxy; $C_{1-18}$-oxycarbonyl; $C_{1-18}$-oxoalkyl; $C_{1-18}$-alkyl sulfanyl; $C_{1-18}$-alkyl sulfonyl; $C_{1-18}$-alkyl imino or amino which is substituted with one, two or three $C_{1-18}$-alkyl groups; and (b) treating the soaked material in an aqueous solution with (i) a hydrogen peroxide source and an enzyme exhibiting peroxidase activity or (ii) an enzyme exibiting oxidase activity on the one or more aromatic or heteroaromatic compounds; wherein the material is a fabric, yarn, fiber, garment or film made of fur, hide, leather, silk or wool.

DETAILED DESCRIPTION OF THE INVENTION

The use of oxidoreductases for dyeing materials has several significant advantages. For example, the dyeing system used in the process of the present invention utilizes inexpensive color precursors. Moreover, the mild conditions in the process will result in less damage to the fabric.

The methods of the present invention can be used to dye materials such as fabrics, yams, fibers, garments and films. Preferably, the material is made of fur. In another rs preferred embodiment, the material is made of hide. In another preferred embodiment, the material is made of leather. In another preferred embodiment, the material is made of silk. In another preferred embodiment, the material is made of wool.

In the methods of the present invention, the material is soaked in an aqueous solution which comprises one or more mono-, di- or polycyclic aromatic or heteroaromatic compounds, each of which is optionally substituted with one or more functional groups or substituents, wherein each functional group or substituent is selected from the group consisting of halogen; sulfo; sulfonato; sulfamino; sulfanyl; amino; amido; nitro; azo; imino; carboxy; cyano; formyl; hydroxy; halocarbonyl; carbamoyl; carbamidoyl; phosphonato; phosphonyl; $C_{1-18}$-alkyl; $C_{2-8}$-alkenyl; $C_{2-8}$-alkynyl; $C_{1-18}$-alkoxy; $C_{1-18}$-oxycarbonyl; $C_{1-18}$-oxoalkyl; $C_{1-18}$-alkyl sulfanyl; $C_{1-18}$-alkyl sulfonyl; $C_{1-18}$-alkyl imino or amino which is substituted with one, two or three $C_{1-18}$-alkyl groups. All $C_{1-18}$-alkyl, $C_{2-8}$-alkenyl and $C_{2-8}$-alkynyl groups may be mono-, di or poly-substituted by any of the proceeding functional groups or substituents. A polycyclic compound for purposes of the present invention has 2, 3 or 4 aromatic rings. Examples of such mono-, di- or polycyclic aromatic or heteroaromatic compounds include, but are not limited to, acridine, anthracene, azulene, benzene, benzofurane, benzothiazole, benzothiazoline, carboline, carbazole, cinnoline, chromane, chromene, chrysene, fulvene, furan, imidazole, indazole, indene, indole, indoline, indolizine, isothiazole, isoquinoline, isoxazole, naphthalene, naphthylene, naphthylpyridine, oxazole, perylene, phenanthrene, phenazine, phtalizine, pteridine, purine, pyran, pyrazole, pyrene, pyridazine, pyridazone, pyridine, pyrimidine, pyrrole, quinazoline, quinoline, quinoxaline, sulfonyl, thiophene, and triazine, each of which are optionally substituted. Examples of such compounds include, but are not limited to, aromatic diamines, aminophenols, phenols and naphthols.

Examples of aromatic and heteroaromatic compounds for use in the present invention include, but are not limited to:

3,4-diethoxyaniline 2-methoxy-p-phenylenediamine, 1-amino-4-b-methoxyethylamino-benzene (N-b-methoxyethyl p-phenylenediamine), 1-amino-4-bis-(b-hydroxyethyl)-aminobenzene (N,N-bis-(b-hydroxyethyl)-p-phenylenediamine), 2-methyl-1,3-diamino-benzene (2,6-diaminotoluene), 2,4-diaminotoluene, 2,6-diaminopyridine, 1-amino-4-sulfonato-benzene, 1-N-methylsulfonato-4-aminobenzene, 1-methyl-2-hydroxy-4-amino-benzene (3-amino o-cresol), 1-methyl-2-hydroxy-4-b-hydroxyethylamino-benzene (2-hydroxy-4-b-hydroxyethylamino-toluene), 1-hydroxy-4-methylamino-benzene (p-methylaminophenol), 1-methoxy-2,4-diamino-benzene (2,4-diaminoanisole), 1-ethoxy-2,3-diamino-benzene (2,4-diaminophenetole), 1-b-hydroxyethyloxy-2,4-diamino-benzene (2,4-diaminophenoxyethanol), 1,3-dihydroxy-2-methylbenzene (2-methyl resorcinol), 1,2,4-trihydroxybenzene, 1,2,4-trihydroxy-5-methylbenzene (2,4,5-trihydroxytoluene), 2,3,5-trihydroxytoluene, 4,8-disulfonato-1-naphtol, 3-sulfonato-6-amino-1-naphtol (J acid), 6,8-disulfonato-2-naphtol, 1,4-Phenylenediamine 2,5-Diaminotoluene 2-Chloro-1,4-phenylenediamine 2-Aminophenol 3-Aminophenol 4-Aminophenol 1,3-Phenylenediamine 1-Naphthol 2-Naphthol 4-Chlororesorcinol 1,2,3-benzenetriol (Pyrogallol)

1,3-Benzenediol (Resorcinol)

1,2-Benzenediol (Pyrocatechol)

2-Hydroxy-cinnamic acid

3-Hydroxy-cinnamic acid

4-Hydroxy-cinnamic acid 2,3-diaminobenzoic acid 2,4-diaminobenzoic acid 3,4-diaminobenzoic acid 3,5-diaminobenzoic acid Methyl-2,3-diaminobenzoate Ethyl-2,3-diaminobenzoate Isopropyl-2,3-diaminobenzoate Methyl-2,4-diaminobenzoate Ethyl-2,4-diaminobenzoate Isopropyl-2,4-diaminobenzoate Methyl-3,4-diaminobenzoate Ethyl-3,4-diaminobenzoate Isopropyl-3,4-diaminobenzoate Methyl-3,5-diaminobenzoate Ethyl-3,5-diaminobenzoate Isopropyl-3,5-diaminobenzoate N,N-dimethyl-3,4-diaminobenzoic acid amide N,N-diethyl-3,4-diaminobenzoic acid amide N,N-dipropyl-3,4-diaminobenzoic acid amide N,N-dibutyl-3,4-diamninobenzoic acid arnide 4-Chloro-1-naphthol N-Phenyl-p-phenylenediamine 3,4-Dihydroxybenzaldehyde Pyrrole Pyrrole-2-isoimidazole 1,2,3-Triazole Benzotriazole Benzimidazole Imidazole Indole 4-amino-5-hydroxy-1-naphthalenesulfonic acid 4,5-Dihydroxynapthalene-2,7-disulfonic acid (Chromotropic acid)

Anthranilic acid

4-Aminobenzoic acid (PABA)

2-Amino-8-naphthol-6-sulfonic acid (Gamma acid)

5-Amino-1-naphthol-3-sulfonic acid (M acid)

2-Naphthol-3,6-disulfonic acid (R acid)

1-Amino-8-naphthol-2,4-disulfonic acid (Chicago acid)

1-Naphthol-4-sulfonic acid (Neville-winther acid)

Peri acid

N-Benzoyl J acid

N-Phenyl J acid 1,7-Cleves acid 1,6-Cleves acid

Bon acid

Naphthol AS

Disperse Black 9

Napphthol AS OL Azoic coupling compound 20 (CI 37530)

Naphthol AS PH Azoic coupling compound 14 (CI 37558)

Naphthol AS KB Azoic coupling compound 21 (CI 37526)

Naphthol AS BS Azoic coupling compound 17 (CI 37515)

Naphthol AS D Azoic coupling compound 18 (CI 37520)

Naphthol AS B1

Mordant Black 3 CI 14640 (Eriochrome Blue Black B)
4-Amino-5-hydroxy-2,6-Naphthalene Disulphonic acid (H acid)
Fat Brown RR Solvent Brown 1 (CI 11285)
Hydroquinone
Mandelic Acid
Melamine
o-Nitrobenzaldehyde
1,5-Dihydroxynaphthalene
2,6-Dihydroxynaphthalene
2,3-Dihydroxynaphthalene
Benzylimidazole
2,3-Diaminonaphthalene
1,5-Diaminonaphthalene
1,8-Diaminonaphthalene
Salicylic acid
3-aminosalicylic acid
4-aminosalicylic acid
5-aminosalicylic acid
Methyl-3-aminosalicylate
Methyl-4-aminosalicylate
Methyl-5-aminosalicylate
Ethyl-3-aminosalicylate
Ethyl-4-aminosalicylate
Ethyl-5-aminosalicylate
Propyl-3-aminosalicylate
Propyl-4-aminosalicylate
Propyl-5-aminosalicylate
Salicylic amide
4-Aminothiophenol
4-Hydroxythiophenol
Aniline
4,4'-Diaminodiphenylamine sulfate
4-Phenylazoaniline
4-Nitroaniline
N,N-Dimethyl-1,4-phenylenediamine
N,N-Diethyl-1,4-phenylenediamine
Disperse Orange 3
Disperse Yellow 9
Disperse Blue 1
N-Phenyl-1,2-phenylenediamine
6-Amino-2-naphthol
3-Amino-2-naphthol
5-Amino-1-naphthol
1,2-Phenylenediamine
2-Aminopyrimidine
4-Aminoquinaldine
2-Nitroaniline
3-Nitroaniline
2-Chloroaniline
3-Chloroaniline
4-Chloroaniline
4-(phenylazo)resorcinol (Sudan Orange G, CI 11920)
Sudan Red B, CI 26110
Sudan Red 7B, CI 26050
4'-Aminoacetanilide
Alizarin
1-Anthramine (1-Aminoanthracene)
1-Aminoanthraquinone
Anthraquinone
2,6-Dihydroxyanthraquinone (Anthraflavic Acid)
1,5-Dihydroxyanthraquinone (Anthrarufin)
3-Amidopyridine (Nicotinamide)
Pyridine-3-carboxylic acid (Nicotinic Acid)
Mordant Yellow 1, Alizarin Yellow GG, CI 14025
Coomassie Grey, Acid Black 48, CI 65005
Palantine Fast Black WAN, Acid Black 52, CI 15711
Palantine Chrome Black 6BN, CI 15705, Eriochrome Blue Black R
Mordant Black 11, Eriochrome Black T
Naphthol Blue Black, Acid Black 1, CI 20470
1,4-Dihydroxyanthraquinone (Quinizarin)
4-Hydroxycoumarin
Umbelliferone, 7-Hydroxycoumarin
Esculetin 6,7-Dihydroxycoumarin
Coumarin
Chromotrope 2B Acid Red 176, CI 16575
Chromotrope 2R Acid Red 29, CI 16570
Chromotrope FB Acid Red 14, CI 14720
2,6-Dihydroxyisonicotinic acid, Citrazinic acid
2,5-Dichloroaniline
2-Amino-4-chlorotoluene
2-Nitro-4-chloroaniline
2-Methoxy-4-nitroaniline and
p-Bromophenol.

After soaking the material in an aqueous solution with the one or more mono-, di- or polycyclic aromatic or heteroaromatic compounds, the material is treated in an aqueous solution with a hydrogen peroxide source and an enzyme exhibiting peroxidase activity or an enzyme exibiting oxidase activity on the one or more aromatic or heteroaromatic compounds. In a preferred embodiment, the same aqueous solution is used to soak and to dye the material. The aqueous solution, i.e., the dye liquor, used to dye the material in the methods of the present invention may have a water/material ratio in the range of about 0.5:1 to about 200:1, preferably about 5:1 to about 20:1.

In the methods of the present invention, the one or more mono-, di- or polycyclic aromatic or heteroaromatic compounds may be oxidized by (a) a hydrogen peroxide source and an enzyme exhibiting peroxidase activity or (b) an enzyme exhibiting oxidase activity on the one or more mono-, di- or polycyclic aromatic or heteroaromatic compounds, e.g., phenols and related substances. Enzymes exhibiting peroxidase activity include, but are not limited to, peroxidase (EC 1.11.1.7) and haloperoxidase, e.g., chloro-(EC 1.11.1.10), bromo-(EC 1.11.1) and iodoperoxidase (EC 1.11.1.8). Enzymes exhibiting oxidase activity include, but are not limited to, bilirubin oxidase (EC 1.3.3.5), catechol oxidase (EC 1.10.3.1), laccase (EC 1.10.3.2), o-amninophenol oxidase (EC 1.10.3.4), and polyphenol oxidase (EC 1.10.3.2). Assays for determining the activity of these enzymes are well known to persons of ordinary skill in the art.

Preferably, the enzyme is a laccase obtained from a genus selected from the group consisting of Aspergillus, Botrytis, Collybia, Fomes, Lentinus, Myceliophthora, Neurospora, Pleurotus, Podospora, Polyporus, Scytalidium, Trametes, and Rhizoctonia. In a more preferred embodiment, the laccase is obtained from a species selected from the group consisting of *Humicola brevis* var. thermoidea, *Humicola brevispora, Humicola* grisea var. thermoidea, *Humicola insolens*, and *Humicola lanuginosa* (also known as *Thermomyces lanuginosus*), *Myceliophthora thermophila, Myceliophthora vellerea, Polyporus pinsitus, Scytalidium thermophila, Scytalidium indonesiacum*, and *Torula thermophila*. The laccase may be obtained from other species of Scytalidium, such as *Scytalidium acidophilum, Scytalidium album, Scytalidium aurantiacum, Scytalidium circinatum, Scytalidium flaveobrunneum, Scytalidium hyalinum, Scytalidium lignicola*, and *Scytalidium uredinicolum*. The laccase may be obtained from a species of Polyporus, such as *Polyporus zonatus, Polyporus alveolaris, Polyporus arcularius, Polyporus australiensis, Polyporus badius, Polyporus biformis, Polyporus brumalis, Polyporus ciliatus, Polyporus colensoi, Polyporus eucalyptorum, Polyporus meridionalis, Polyporus varius, Polyporus palustris, Polyporus rhizophilus, Polyporus rugulosus, Polyporus squamosus, Polyporus tuberaster*, and *Polyporus tumulosus*. The laccase may also be obtained from a species of Rhizoctonia, erg., *Rhizoctonia solani*. The laccase may also be a modified laccase by at least one amino acid residue in a Type I (T1) copper site, wherein the modified oxidase possesses an altered pH and/or specific activity relative to the wild-type oxidase. For example, the modified laccase could be modified in segment (a) of the T1 copper site.

Peroxidases which may be employed for the present purpose may be isolated from and are producible by plants (e.g., horseradish peroxidase) or microorganisms such as fungi or bacteria. Some preferred fungi include strains belonging to the subdivision Deuteromycotina, class Hyphomycetes, e.g., Fusarium, Humicola, Trichoderma, Myrothecium, Verticillum, Arthromyces, Caldariomyces, Ulocladium, Embellisia, Cladosporium or Dreschlera, in particular *Fusarium oxysporum* (DSM 2672), *Humicola insolens, Trichoderma resii, Myrothecium verrucana* (IFO 6113), *Verticillum alboatrum, Verticillum dahlie, Arthromyces ramosus* (FERM P-7754), *Caldariomyces fumago, Ulocladium chartarum, Embellisia alli* or *Dreschlera halodes.*

Other preferred fungi include strains belonging to the subdivision Basidiomycotina, class Basidiomycetes, e.g., Coprinus, Phanerochaete, Coriolus or Trametes, in particular *Coprinus cinereus* f. microsporus (IFO 8371), *Coprinus macrorhizus, Phanerochaete chrysosporium* (e.g., NA-12) or *Coriolus versicolor* (e.g., PR4 28-A).

Further preferred fungi include strains belonging to the subdivision Zygomycotina, class Mycoraceae, e.g., Rhizopus or Mucor, in particular *Mucor hiemalis.*

Some preferred bacteria include strains of the order Actinomycetales, e.g., *Streptomyces spheroides* (ATTC 23965), *Streptomyces thermoviolaceus* (IFO 12382) or *Streptoverticillum verticillium* ssp. verticillium.

Other preferred bacteria include *Bacillus pumillus* (ATCC 12905), *Bacillus stearothermophilus, Rhodobacter sphaeroides, Rhodomonas palustri, Streptococcus lactis, Pseudomonas purrocinia* (ATCC 15958) or *Pseudomonas fluorescens* (NRRL B-11).

Other potential sources of peroxidases are listed in B.C. Saunders et al., op. cit., pp. 41–43.

Methods of producing enzymes to be used according to the invention are described in the art, e.g., *FEBS Letters* 1625, 173(1), *Applied and Environmental Microbiology*, February 1985, pp. 273–278, *Applied Microbiol. Biotechnol.* 26, 1987, pp. 158–163, *Biotechnology Letters* 9(5), 1987, pp. 357–360, *Nature* 326, 2 April 1987, *FEBS Letters* 4270, 209(2), p. 321, EP 179 486, EP 200 565, GB 2 167 421, EP 171 074, and *Agric. Biol. Chem.* 50(1), 1986, p. 247.

Particularly preferred enzymes are those which are active at a pH in the range of about 2.5 to about 12.0, preferably in the range of about 4 to about 10, most preferably in the range of about 4.0 to about 7.0 and in the range of about 7.0 to about 10.0. Such enzymes may be isolated by screening for the relevant enzyme production by alkalophilic microorganisms, e.g., using the ABTS assay described in R. E. Childs and W. G. Bardsley, *Biochem. J.* 145, 1975, pp. 93–103.

Other preferred enzymes are those which exhibit a good thermostability as well as a good stability towards commonly used dyeing additives such as non-ionic, cationic, or anionic surfactants, chelating agents, salts, polymers, etc.

The enzymes may also be produced by a method comprising cultivating a host cell transformed with a recombinant DNA vector which carries a DNA sequence encoding said enzyme as well as DNA sequences encoding finctions permitting the expression of the DNA sequence encoding the enzyme, in a culture medium under conditions permitting the expression of the enzyme and recovering the enzyme from the culture.

A DNA fragment encoding the enzyme may, for instance, be isolated by establishing a cDNA or genomic library of a microorganism producing the enzyme of interest, such as one of the organisms mentioned above, and screening for positive clones by conventional procedures such as by hybridization to oligonucleotide probes synthesized on the basis of the full or partial amino acid sequence of the enzyme, or by selecting for clones expressing the appropriate enzyme activity, or by selecting for clones producing a protein which is reactive with an antibody against the native enzyme.

Once selected, the DNA sequence may be inserted into a suitable replicable expression vector comprising appropriate promotor, operator and terminator sequences permitting the enzyme to be expressed in a particular host organism, as well as an origin of replication enabling the vector to replicate in the host organism in question.

The resulting expression vector may then be transformed into a suitable host cell, such as a fungal cell, preferred examples of which are a species of Aspergillus, most preferably *Aspergillus oryzae* or *Aspergillus niger*. Fungal cells may be transformed by a process involving protoplast formation and transformation of the protoplasts followed by regeneration of the cell wall in a manner known per se. The use of Aspergillus as a host microorganism is described in EP 238,023 (of Novo Industri A/S), the contents of which are hereby incorporated by reference.

Alternatively, the host organisms may be a bacterium, in particular strains of Streptomyces, Bacillus, or *E. coli*. The transformation of bacterial cells may be performed according to conventional methods, e.g., as described in T. Maniatis et al., *Molecular Cloning: A Laboratory Manual*, Cold Spring Harbor, 1982.

The screening of appropriate DNA sequences and construction of vectors may also be carried out by standard procedures, cf. T. Maniatis et al., op. cit.

The medium used to cultivate the transformed host cells may be any conventional medium suitable for growing the host cells in question. The expressed enzyme may conveniently be secreted into the culture medium and may be recovered therefrom by well-known procedures including separating the cells from the medium by centrifugation or filtration, precipitating proteinaceous components of the medium by means of a salt such as ammonium sulphate, followed by chromatographic procedures such as ion exchange chromatography, affinity chromatography, or the like.

When the enzyme employed in the invention is a peroxidase, a hydrogen peroxide source, e.g., hydrogen peroxide itself, must be used. The hydrogen peroxide source may be added at the beginning or during the process, e.g., in an amount of 0.001–5 mM, particularly 0.01–1 mM.

One source of hydrogen peroxide includes precursors of hydrogen peroxide, e.g., a perborate or a percarbonate. Another source of hydrogen peroxide includes enzymes which are able to convert molecular oxygen and an organic or inorganic substrate into hydrogen peroxide and the oxidized substrate, respectively. These enzymes produce only low levels of hydrogen peroxide, but they may be employed to great advantage in the process of the invention as the presence of peroxidase ensures an efficient utilization of the hydrogen peroxide produced. Examples of enzymes which are capable of producing hydrogen peroxide include, but are not limited to, glucose oxidase, urate oxidase, galactose oxidase, alcohol oxidase, amine oxidase, amino acid oxidase and cholesterol oxidase.

In the methods of the present invention, the material is dyed at a temperature in the range of about 5 to about 120° C., preferably in the range of about 5 to about 80° C., and more preferably in the range of about 15 to about 70° C., and at a pH in the range of about 2.5 to about 12, preferably between about 4 and about 10, more preferably in the range of about 4.0 to about 7.0 or in the range of about 7.0 to about 10.0, can be used. More preferably, a pH below 6.5 (e.g., a pH in the range of 3–6, preferably in the range of 4–6 and most preferably in the range of 4.5–5.5) or above 8.0 (e.g., a pH in the range of 8–10, preferably in the range of 8.5–10 and most preferably in the range of 9–10), is used. Surprisingly, the colors of the materials dyed by the methods of the present invention at a pH below 6.5 and above 8.0 are different than the colors of the same materials dyed by methods at a pH in the range of 6.5–8.0. In a most preferred embodiment, a temperature and pH near the temperature and pH optima of the enzyme, respectively, are used.

In a preferred embodiment, the methods of the present invention further comprise adding to the aqueous solution a mono- or divalent ion which includes, but is not limited to, sodium, potassium, calcium and magnesium ions (0–3 M, preferably 25 mM–1 M), a polymer which includes, but is not limited to, polyvinylpyrrolidone, polyvinylalcohol, polyaspartate, polyvinylamide, polyethelene oxide (0–50 g/l, preferably 1–500 mg/l) and a surfactant (10 mg–5 g/l).

Examples of such surfactants are anionic surfactants such as carboxylates, for example, a metal carboxylate of a long chain fatty acid; N-acylsarcosinates; mono or di-esters of phosphoric acid with fatty alcohol ethoxylates or salts of such esters; fatty alcohol sulphates such as sodium dodecyl sulphate, sodium octadecyl sulphate or sodium cetyl sulphate; ethoxylated fatty alcohol sulphates; ethoxylated alkylphenol sulphates; lignin sulphonates; petroleum sulphonates; alkyl aryl sulphonates such as alkyl-benzene sulphonates or lower alkylnaphthalene sulphonates, e.g., butyl-naphthalene sulphonate; salts or sulphonated naphthalene-formaldehyde condensates; salts of sulphonated phenol-formaldehyde condensates; or more complex sulphonates such as amide sulphonates, e.g., the sulphonated condensation product of oleic acid and N-methyl taurine or the dialkyl sulphosuccinates, e.g., the sodium sulphonate or dioctyl succinate. Further examples of such surfactants are non-ionic surfactants such as condensation products of fatty acid esters, fatty alcohols, fatty acid amides or fatty-alkyl- or alkenyl-substituted phenols with ethylene oxide, block copolymers of ethylene oxide and propylene oxide, acetylenic glycols such as 2,4,7,9-tetraethyl-5-decyn-4,7-diol, or ethoxylated acetylenic glycols. Further examples of such surfactants are cationic surfactants such as aliphatic mono-, di-, or polyamines such as acetates, naphthenates or oleates; oxygen-containing amines such as an amine oxide of polyoxyethylene alkylamine; amide-linked amines prepared by the condensation of a carboxylic acid with a di- or polyamine; or quaternary ammonium salts.

In another preferred embodiment, the methods of the present invention further comprise adding to the aqueous solution an agent which enhances the activity of the enzyme exhibiting peroxidase activity or the enzyme exhibiting oxidase activity. Enhancing agents are well known in the art. For example, the organic chemical compounds disclosed in WO 95/01426 are known to enhance the activity of a laccase. Furthermore, the chemical compounds disclosed in WO 94/12619 and WO 94/12621 are known to enhance the activity of a peroxidase.

The invention is further illustrated by the following non-limiting examples.

EXAMPLES

Example 1

DETERMINATION OF LACCASE ACTIVITY

Laccase activity was determined from the oxidation of syringaldazin under aerobic conditions. The violet color produced was measured by spectrophotometry at 530 nm. The analytical conditions were 19 μM syringaldazin, 23.2 mM acetate buffer, pH 5.5, 30° C., and 1 minute reaction time. One laccase unit (LACU) is the amount of laccase that catalyzes the conversion of 1 μmole syringaldazin per minute at these conditions.

DETERMINATION OF PEROXIDASE ACTIVITY

One peroxidase unit (POXU) is the amount of enzyme that catalyzes the conversion of 1 μmol hydrogen peroxide per minute at the following analytical conditions: 0.88 mM hydrogen peroxide, 1.67 mM 2,2--azinobis(3-ethylbenzothiazoline-6-sulfonate), 0.1 M phosphate buffer (containing Triton X405 (1.5 g/1000 ml)), pH 7.0, incubated at 30° C., photometrically followed at 418 nm (extinction coefficient of ABTS is set to 3.6 l/mmol*mm)).

DYEING OF FABRICS

Five mg of a first compound (p-phenylenediamine ("A"), p-tolulenediamine ("B"), or o-aminophenol ("C")) and 5 mg of a second compound (m-phenylenediamine ("D"), α-naphthol ("E"), or 4-chlororesorcinol ("F")) (or 10 mg of the first compound in experiments without the second compound) were dissolved in 10 ml of 0.1 M $K_2HPO_4$, pH 7.0, buffer. A *Polyporus pinsitus* laccase ("PpL") with an activity of 71.7 LACU/ml (deposited with the Centraal Bureau voor Schimmelcultures and given accession number CBS 678.70) or a *Myceliophthora thermophila* laccase ("MtL") with an activity of 690 LACU/ml (deposited with the Centraal Bureau voor Schimmelcultures and given accession number CBS 117.65)) was diluted in the same buffer to an activity of 10 LACU/ml.

Multifiber swatches Style 10A (4×10 cm) obtained from Test Fabrics Inc. (Middlesex, N.J.) were rolled up and placed in a test tube. The swatches contained a strip of a fiber made of wool. 4.5 ml of the precursor/coupler solution and 1 ml of the laccase solution were added to the test tube. The test tube was closed, mixed and mounted in a test tube shaker and incubated for 60 minutes in a dark cabinet. After incubation the swatches were rinsed in running hot tap water for about 30 seconds.

The results of the experiment are provided in the following tables:

TABLE 1

| FABRIC | A alone | A + D | A + E | A + F |
|---|---|---|---|---|
| wool | gray brown | dark blue | dark purple | brown |

TABLE 2

| FABRIC | B alone | B + D | B + E | B + F |
|---|---|---|---|---|
| wool | brown | dark blue | blue brown | yellow/brown |

TABLE 3

| FABRIC | C alone | C + D | C + E | C + F |
|---|---|---|---|---|
| wool | orange/red | strong orange/red | strong orange | strong orange |

The results demonstrate that color is formed on wool in the presence of precursor and *Polyporus pinsitus* laccase. Similar results were obtained with the *Myceliophthora thermophila* laccase.

Example 2

Various materials were dyed in an Atlas Launder-O-Meter ("LOM") at 30° C. for 1 hour at a pH in the range of 4–10. The materials dyed (all obtained from Test Fabrics Inc.) were worsted wool (Style 526, 7 cm×7 cm) and chlorinated worsted wool (Style 530, 7 cm×7 cm).

A 0.1 M Britten-Robinson buffer solution was prepared at the appropriate pH by mixing solution A (0.1 M $H_3PO_4$, 0.1 M $CH_3COOH$, 0.1 M $H_3BO_3$) and B (0.5 M NaOH). In order to produce buffer solutions at pH's 4, 5, 6, 7, 8, 9 and 10, 806 ml, 742 ml, 706 ml, 656 ml, 624 ml, 596 ml and 562 ml of solution A, respectively, were diluted to one liter with solution B.

To 75 ml of each buffer solution was added 0.5 mg/ml of a compound selected from p-phenylenediamine, o-aminophenol and m-phenylenediamine. The pH was checked and adjusted if necessary. The 75 ml buffer/compound solutions were combined to form 150 ml of each buffer/compound combination solution which was added to a LOM beaker.

Swatches of the materials were then soaked in each buffer/compound combination solution. A volume corresponding to the volume of laccase to be added was then withdrawn. A *Myceliophthora thermophila* laccase ("MtL") with an activity of 690 LACU/ml was diluted in the buffer solution to an activity of 300 LACU/ml. 2 LACU/ml was added for each pH, except pH 7.0. At pH 7.0, 0, 1, 2, and 4 LACU/ml was added for the dosing profile. The LOM beakers were then mounted on the LOM. After 1 hour at 42 RPM and 30° C., the LOM was stopped. The liquid was poured off and the swatches were rinsed in the beaker in running deionized water for about 15 minutes. The swatches were dried and the CIELAB values measured using a ColorEye 7000 instrument. The CIELAB results are given in Tables 4–7.

TABLE 4

Dyeing with precursors p-phenylenediamine and m-phenylenediamine pH-profile, 2 LACU/ml

| | | pH 4 | pH 5 | pH 6 | pH 7 | pH 8 | pH 9 | pH 10 |
|---|---|---|---|---|---|---|---|---|
| Worsted | L* | 41.57 | 28.21 | 20.25 | 14.73 | 18.94 | 35.06 | 13.52 |
| Wool | a* | 2.71 | 1.24 | 0.43 | 1.63 | 3.56 | −1.92 | 1.79 |
| | b* | −0.75 | −2.09 | −5.76 | −5.84 | −17.52 | −14.05 | −4.28 |
| Chlori- | L* | 18.46 | 16.05 | 15.04 | 14.19 | 15.47 | 31.44 | 13.84 |
| nated | a* | 2.32 | 1.01 | 0.88 | 1.83 | 2.78 | −3.05 | 2.97 |
| Wool | b* | 0.09 | 0.87 | 1.03 | 1.53 | −11.43 | −13.27 | 2.06 |

TABLE 5

Dyeing with precursors p-phenylenediamine and m-phenylenediamine Dosing profile - pH 7

| | | 0 LACU | 1 LACU | 4 LACU |
|---|---|---|---|---|
| Worsted | L* | 54.97 | 14.52 | 14.27 |
| Wool | a* | 1.48 | 1.55 | 1.49 |
| | b* | 1.26 | −6.09 | −5.6 |
| Chlorinated | L* | 43.2 | 14.42 | 14.33 |
| Wool | a* | 1.79 | 1.75 | 1.69 |
| | b* | 1.61 | 1.5 | 1.65 |

TABLE 6

Dyeing with precursors o-aminophenol and m-phenylenediamine pH-profile, 2 LACU/ml

| | | pH 4 | pH 5 | pH 6 | pH 7 | pH 8 | pH 9 | pH 10 |
|---|---|---|---|---|---|---|---|---|
| Worsted | L* | 33.68 | 33.05 | 35.96 | 37.42 | 42.55 | 59.24 | 49.65 |
| Wool | a* | 3.77 | 5.35 | 8.56 | 10.07 | 8.75 | 10.53 | 8.63 |
| | b* | 8.26 | 11.03 | 18.83 | 22.33 | 22.82 | 37.2 | 34.81 |
| Chlori- | L* | 21.07 | 19.11 | 21.01 | 24.7 | 34.42 | 59.9 | 48.74 |
| nated | a* | 3.14 | 2.77 | 4.82 | 7.22 | 6.88 | 10.08 | 10.4 |
| Wool | b* | 4.23 | 4.31 | 8.04 | 12.64 | 18.08 | 36.78 | 34.76 |

TABLE 7

Dyeing with precursors o-aminophenol and m-phenylenediamine Dosing profile - pH 7

| | | 0 LACU | 1 LACU | 4 LACU |
|---|---|---|---|---|
| Worsted | L* | 80.23 | 38.57 | 36.18 |
| Wool | a* | 1.1 | 9.21 | 10.8 |
| | b* | 20.09 | 21.33 | 22.76 |
| Chlorinated | L* | 77.36 | 27.1 | 26.33 |
| Wool | a* | 0.86 | 7.92 | 6.92 |
| | b* | 19.53 | 14.8 | 13.5 |

The parameters "L1", "a*" and "b*" used in the tables are used to quantify color and are well known to persons of ordinary skill in the art of color science. See for example, Billmeyer & Saltzman, *Principles of Color Technology*, Second Edition, John Wiley & Sons, New York, 1981, p. 59.

The results show that worsted wool and chlorinated worsted wool were dyed at all pH's, with strong shades ranging from gray at low pH to marine blue and black at high pH with the combination of p-phenylenediamine and m-phenylenediamine and shades from brown at low pH to orange/yellow at high pH with the combination of o-aminophenol and m-phenylenediamine.

In all dosing experiments, no notable difference was seen from dosing 1, 2 or 4 LACU/ml. The control experiment with 0 LACU/ml clearly demonstrates that dyeing is catalyzed by the laccase.

Example 3

The time profile for dyeing was determined using the procedure described in Example 2 except the experiments were conducted only at pH 5.0 and 8.0 over time intervals of 0, 5, 15, 35 and 55 minutes. In each experiment, 2 LACU/ml of the *Myceliophthora thermophila* laccase was added. The results are shown in Tables 8–11.

TABLE 8

Dyeing with precursors p-phenylenediamine and m-phenylenediamine
Time profile, 2 LACU/ml, pH 5

| | | 0 min | 5 min | 15 min | 35 min | 55 min |
|---|---|---|---|---|---|---|
| Worsted | L* | 76.48 | 52.08 | 36.3 | 27.02 | 26.56 |
| Wool | a* | 0.02 | 1.35 | 1.96 | 1.3 | 1.18 |
| | b* | 8 | −0.02 | −1.39 | −1.68 | −2.03 |
| Chlorinated | L* | 63.73 | 19.23 | 16.81 | 16.48 | 16.75 |
| Wool | a* | 0.1 | 1.86 | 1.28 | 0.77 | 1.11 |
| | b* | 10.3 | −0.68 | 0.49 | 1.04 | 1.03 |

TABLE 9

Dyeing with precursors p-phenylenediamine and m-phenylenediamine
Time profile, 2 LACU/ml, pH 8

| | | 0 min | 5 min | 15 min | 35 min | 55 min |
|---|---|---|---|---|---|---|
| Worsted | L* | 64.43 | 23.66 | 14.57 | 13.11 | 13.06 |
| Wool | a* | −3.03 | 1.05 | 2.14 | 1.49 | 1.2 |
| | b* | −3.32 | −15.45 | −8.72 | −4.52 | −3.68 |
| Chlorinated | L* | 58.96 | 17.36 | 14.09 | 13.89 | 13.66 |
| Wool | a* | −1.66 | 0.57 | 1.9 | 2.71 | 2.64 |
| | b* | 2.68 | −3.98 | 0.14 | 2.21 | 1.99 |

TABLE 10

Dyeing with precursors o-aminophenol and m-phenylenediamine
Time profile, 2 LACU/ml, pH 5

| | | 0 min | 5 min | 15 min | 35 min | 55 min |
|---|---|---|---|---|---|---|
| Worsted | L* | 79.4 | 50.67 | 35.94 | 32.4 | 32.89 |
| Wool | a* | 1.54 | 6.47 | 7.11 | 6.08 | 5.98 |
| | b* | 16.02 | 20.88 | 18.43 | 14.28 | 12.52 |
| Chlorinated | L* | 76.72 | 39.53 | 22.12 | 18.82 | 19.58 |
| Wool | a* | 2.33 | 6.81 | 4.21 | 2.88 | 3.1 |
| | b* | 18.26 | 16.48 | 8.23 | 4.89 | 4.77 |

TABLE 11

Dyeing with precursors o-aminophenol and m-phenylenediamine
Time profile, 2 LACU/ml, pH 8

| | | 0 min | 5 min | 15 min | 35 min | 55 min |
|---|---|---|---|---|---|---|
| Worsted | L* | 80.06 | 63.03 | 49.37 | 42.51 | 41.24 |
| Wool | a* | 1.63 | 15.71 | 17.1 | 12.32 | 9.97 |
| | b* | 25.87 | 43.37 | 38.69 | 30.26 | 25.78 |
| Chlorinated | L* | 79.6 | 62.87 | 47.88 | 36.72 | 33.62 |
| Wool | a* | 0.57 | 13.17 | 14.46 | 10.26 | 7.88 |
| | b* | 24.63 | 41.64 | 34.34 | 24.47 | 19.7 |

The results show that most of the color forms within the first 15 minutes. Worsted wool and chlorinated worsted wool were dyed at both pH's.

Example 4

Wool was dyed in an Atlas Launder-O-Meter ("LOM") at 30° C. for one hour at pH 5.5. The material dyed (obtained from Test Fabrics, Inc.) was worsted wool (style 526, 8 cm×8 cm).

A 0.5 mg/ml solution of a first compound (p-phenylenediamine, "A") and a 0.5 mg/ml solution of a second compound (1-naphthol, "B") was prepared by dissolving the compound in the appropriate amount of 0.1 M $CH_3COONa$, pH 5.5, buffer. A total volume of 100 ml was used in each LOM beaker. 100 ml "A" was added to one beaker and 50 ml "A" and 50 ml "B" were combined to form 100 ml in a second beaker. Swatches of the materials listed above were wetted in DI water and soaked in the precursor solutions. A *Myceliophthora thermophila* laccase ("MtL") with an activity of 690 LACU/ml (80 LACU/mg) was added to each beaker at a concentration of 12.5 mg/l. The LOM beakers were sealed and mounted in the LOM. After 1 hour at 42 RPM and 30° C., the LOM was stopped. The spent liquor was poured off and the swatches were rinsed in cold tap water for about 15 minutes. The swatches were dried at room temperature and CIELAB values were measured for all of the swatches using the Macbeth ColorEye 7000. The results are given in Tables 12 and 13.

TABLE 12

Dyeing with precursor p-phenylenediamine
pH 5.5, 12.5 mg/l MtL

| | L* | a* | b* |
|---|---|---|---|
| Wool | 30.93 | 61.66 | 10.10 |

TABLE 13

Dyeing with precursors p-phenylnediamine and 1-naphthol
pH 5.5, 12.5 mg/l MtL

| | L* | a* | b* |
|---|---|---|---|
| Wool | 30.70 | 61.12 | −4.28 |

The results show that wool can be dyed (brown using A, purple using A/B) using precursor and *Myceliophthora thermophila* laccase.

Example 5

Wool was dyed in an Atlas Launder-O-Meter ("LOM") at 30° C. for one hour at pH 5.5. The material dyed (obtained from Test Fabrics, Inc.) was worsted wool (style 526, 8 cm×8 cm).

A 0.5 mg/ml solution of a first compound (p-phenylenediamine, "A") and a 0.5 mg/ml solution of a second compound (1-naphthol, "B") was prepared by dissolving the compound in the appropriate amount of 0.1 M $CH_3COONa$, pH 5.5, buffer. A total volume of 100 ml was used in each LOM beaker. 100 ml "A" was added to one beaker and 50 ml "A" and 50 ml "B" were combined to form 100 ml in a second beaker. Swatches of the materials listed above were wetted in DI water and soaked in the precursor solutions. A *Polyporus pinsitus* laccase ("PpL") with an activity of 70 LACU/ml (100 LACU/mg) was added to each beaker at a concentration of 12.5 mg/l. The LOM beakers were sealed and mounted in the LOM. After 1 hour at 42 RPM and 30C, the LOM was stopped. The spent liquor was poured off and the swatches were rinsed in cold tap water for about 15 minutes. The swatches were dried at room temperature CIELAB values were measured for all of the swatches using the Macbeth ColorEye 7000. The results are given in Tables 14 and 15.

TABLE 14

| Dyeing with precursor p-phenylenediamine pH 5.5, 12.5 mg/l PpL | | | |
|---|---|---|---|
| | L* | a* | b* |
| Wool | 36.06 | 70.46 | 8.49 |

TABLE 15

| Dyeing with precursors p-phenylnediamine and 1-naphthol pH 5.5, 12.5 mg/l PpL | | | |
|---|---|---|---|
| | L* | a* | b* |
| Wool | 37.92 | 58.71 | −2.23 |

The results show that wool can be dyed (brown using A, purple using A/B) using precursor and *Polyporous pinsitus* laccase.

Example 6

Wool was dyed in an Atlas Launder-O-Meter ("LOM") at 30° C. for one hour at pH 5.5. The material dyed (obtained from Test Fabrics, Inc.) was worsted wool (style 526, 8 cm×8 cm).

A 0.5 mg/ml solution of a first compound (p-phenylenediamine, "A") and a 0.5 mg/ml solution of a second compound (1-naphthol, "B") was prepared by dissolving the compound in the appropriate amount of 0.1 M $CH_3COONa$, pH 5.5, buffer. A total volume of 100 ml was used in each LOM beaker. 100 ml "A" was added to one beaker and 50 ml "A" and 50 ml "B" were combined to form 100 ml in a second beaker. Swatches of the materials listed above were wetted in DI water and soaked in the precursor solutions. A *Myrothecium verrucaria* bilirubin oxidase ("BiO") with an activity of 0.04 LACU/mg (1 mg/ml) was added to each beaker at a concentration of 12.5 mg/l. The LOM beakers were sealed and mounted in the LOM. After 1 hour at 42 RPM and 30° C., the LOM was stopped. The spent liquor was poured off and the swatches were rinsed in cold tap water for about 15 minutes. The swatches were dried at room temperature and CIELAB values were measured for all of the swatches using the Macbeth ColorEye 7000. The results are given in Tables 16 and 17.

TABLE 16

| Dyeing with precursor p-phenylenediamine | | | |
|---|---|---|---|
| | L* | a* | b* |
| Wool | 27.54 | 80.84 | −2.13 |

TABLE 17

| Dyeing with precursors p-phenylnediamine and 1-naphthol | | | |
|---|---|---|---|
| | L* | a* | b* |
| Wool | 40.21 | 87.73 | −13.47 |

The results show that wool can be dyed (brown using A, purple using A/B) using precursor and bilirubin oxidase.

Example 7

Wool was dyed in an Atlas Launder-O-Meter ("LOM") at 30° C. for one hour at pH 5.5. The material dyed (obtained from Test Fabrics, Inc.) was worsted wool (style 526, 8 cm×8 cm).

A 0.5 mg/ml solution of a first compound (p-phenylenediamine, "A") and a 0.5 mg/ml solution of a second compound (1-naphthol, "B") was prepared by dissolving the compound in the appropriate amount of 0.1 M $CH_3COONa$, pH 5.5, buffer. A total volume of 100 ml was used in each LOM beaker. 100 ml "A" was added to one beaker and 50 ml "A" and 50 ml "B" were combined to form 100 ml in a second beaker. Swatches of the materials listed above were wetted in DI water and soaked in the precursor solutions. A *Rhizoctonia solani* laccase ("RsL") with an activity of 5.2 LACU/ml (2 mg/ml) was added to each beaker at a concentration of 12.5 mg/l. The LOM beakers were sealed and mounted in the LOM. After 1 hour at 42 RPM and 30° C., the LOM was stopped. The spent liquor was poured off and the swatches were rinsed in cold tap water for about 15 minutes. The swatches were dried at room temperature and CIELAB values were measured for all of the swatches using the Macbeth ColorEye 7000. The results are given in Tables 18 and 19.

TABLE 18

| Dyeing with precursor p-phenylenediamine pH 5.5, 12.5 mg/l RsL | | | |
|---|---|---|---|
| | L* | a* | b* |
| Wool | 27.89 | 58.97 | 1.59 |

TABLE 19

| Dyeing with precursors p-phenylnediamine and 1-naphthol pH 5.5, 12.5 mg/l RsL | | | |
|---|---|---|---|
| | L* | a* | b* |
| Wool | 29.03 | 63.94 | −3.65 |

The results show that wool can be dyed (brown using A, purple using A/B) using precursor and *Rhizoctonia solani* laccase.

Example 8

The material dyed (obtained from Test Fabrics Inc.) was Wool (Style 526, 8 cm×8 cm) in an Atlas Launder-O-Meter ("LOM") at 60° C. and pH 5.5.

A 0.25 mg/ml solution of a first compound (p-phenylenediamine, "A") and a 0.25 mg/ml solution of a second compound (2-aminophenol, "B") were prepared by dissolving the compound in the appropriate amount of a 2 g/L $CH_3COONa$, pH 5.5, buffer. A total volume of 100 ml was used in each LOM beaker. 50 ml "A" and 50 ml "B" were combined to form 100 ml in an LOM beaker. Swatches of the material listed above were wetted in DI water and soaked in the precursor solutions. The LOM beakers were sealed and mounted in the LOM. After a 10, 15, or 30 minute incubation time in the LOM (42 RPM), the LOM was stopped and a *Myceliophthora thermophila* laccase ("MtL") with an activity of 690 LACU/ml (80 LACU/mg) was added to each beaker at a concentration of 1 LACU/ml. After 50, 45 or 30 minutes at 42 RPM and 60° C., the LOM was stopped and the sample was removed. Two controls without preincubation were made by adding the precursor solution, swatches, and enzyme to LOM beakers. The beakers were mounted in the LOM. After 30 minutes at 42 RPM and 60° C., one beaker was removed. The other control was run for a total of 60 minutes at 42 RPM and 60° C. and then removed. The spent liquor was poured off the samples and the swatches were rinsed in cold tap water for about 15 minutes. The swatches were dried at room temperature and CIELAB values were measured for all of the swatches using the Macbeth ColorEye 7000. The results are given in Tables 20–24.

TABLE 20

| Control Dyeing with precursors A and B, 0 min./30 min. | | | |
|---|---|---|---|
| | L* | a* | b* |
| Wool | 36.26 | 2.01 | 7.28 |

TABLE 21

| Control Dyeing with precursors A and B, 0 min./60 min. | | | |
|---|---|---|---|
| | L* | a* | b* |
| Wool | 36.49 | 2.28 | 7.42 |

TABLE 22

| Dyeing with precursors A and B, 10 min./50 min. | | | |
|---|---|---|---|
| | L* | a* | b* |
| Wool | 32.95 | 2.41 | 10.16 |

TABLE 23

| Dyeing with precursors A and B, 15 min./45 min. | | | |
|---|---|---|---|
| | L* | a* | b* |
| Wool | 33.20 | 2.65 | 10.80 |

TABLE 24

| Dyeing with precursors A and B, 30 min./30 min. | | | |
|---|---|---|---|
| | L* | a* | b* |
| Wool | 33.45 | 2.87 | 11.59 |

The colorfastness to laundering (washfastness) for these swatches was evaluated using the American Association of Textile Chemist and Colorist (AATCC) Test Method 61-1989, 2A. The Launder-O-Meter was preheated to 49° C. and 200 ml 0.2% AATCC Standard Reference Detergent WOB (without optical brightener) and 50 steel balls were placed in each LOM beaker. The beakers were sealed and mounted in the LOM and run at 42 RPM for 2 minutes to preheat the beakers to the test temperature. The rotor was stopped and the beakers were unclamped. The swatches were added to the beakers and the LOM was run for 45 minutes. The beakers were removed and the swatches rinsed in hot tap water for 5 minutes, with occasional squeezing. The swatches were then dried at room temperature and evaluated by the Macbeth ColorEye 7000. A gray scale rating (1–5) was assigned to each swatch using the AATCC Evaluation Procedure 1, Gray Scale for Color Change. The results are given in Tables 25–29.

TABLE 25

| Washfastness Results for A and B, 0 min./30 min. | | | | |
|---|---|---|---|---|
| | L* | a* | b* | Gray Scale Rating |
| Wool | 40.10 | 2.06 | 3.53 | 3 |

TABLE 26

| Washfastness Results for A and B, 0 min./60 min. | | | | |
|---|---|---|---|---|
| | L* | a* | b* | Gray Scale Rating |
| Wool | 39.93 | 2.27 | 4.25 | 3 |

TABLE 27

| Washfastness Results for A and B, 15 min./45 min. | | | | |
|---|---|---|---|---|
| | L* | a* | b* | Gray Scale Rating |
| Wool | 36.02 | 2.70 | 4.93 | 3–4 |

TABLE 28

| Washfastness Results for A and B, 10 min./50 min. | | | | |
|---|---|---|---|---|
| | L* | a* | b* | Gray Scale Rating |
| Wool | 35.09 | 2.62 | 4.45 | 4 |

TABLE 29

| Washfastness Results for A and B, 30 min./30 min. | | | | |
|---|---|---|---|---|
| | L* | a* | b* | Gray Scale Rating |
| Wool | 35.86 | 2.89 | 5.38 | 4 |

The results show that wool can be dyed using precursor and *Myceliophthora thermophila* laccase. Both from the L* and the gray scale rating, it is evident that color intensity and washfastness are improved by incubating the swatches in the precursor solution before adding the enzyme.

Example 9

The materials dyed (all obtained from Test Fabrics Inc.) were worsted wool (Style 526, 7 cm×7 cm) and chlorinated worsted wool (Style 530, 7 cm×7 cm) in an Atlas Launder-O-Meter ("LOM") at 40° C. for one hour at a pH 5.5.

Two mediators were evaluated in this experiment and each was dissolved in a buffer solution. Three buffer solutions were made: a 2 g/L $CH_3COONa$, pH 5.5, buffer ("1"), a 2 g/L $CH_3COONa$, pH 5.5, buffer containing 100 AM 1 0-propionic acid-phenothiazine (PPT) ("2"), and a 2 g/L $CH_3COONa$, pH 5.5, buffer containing 100 $\mu$M methyl syringate ("3").

Three 0.25 mg/ml solutions of a first compound (p-phenylenediamine, "A") and three 0.25 mg/ml solutions of a second compound (m-phenylenediamine, "B") were prepared by dissolving the compound in the appropriate amount of buffer (1, 2 or 3). A total volume of 120 ml was used in each LOM beaker. 60 ml of A and 60 ml of B were combined to form 120 ml (for each buffer: 1, 2, or 3).

Swatches of the materials listed above were wetted in DI water and soaked in the precursor solutions. The LOM beakers were sealed and mounted in the LOM. After 10 minutes at 42 RPM and 40° C., the LOM was stopped. A *Myceliophthora thermophila* laccase ("MtL") with an activity of 690 LACU/ml (80 LACU/mg) was added to each beaker at an activity of 0.174 LACU/ml. The beakers were once again sealed and mounted in LOM and run (42 RPM) for 50 minutes at 40° C. The beakers were removed and the spent liquor was poured off and the swatches were rinsed in cold tap water for about 15 minutes. The swatches were dried at room temperature and CIELAB values were measured for all of the swatches using the Macbeth ColorEye 7000. The results are given in Tables 30, 31 and 32.

TABLE 30

Dyeing with precursors A and B (2 g/L $CH_3COONa$, pH 5.5, MtL

| | L* | a* | b* |
|---|---|---|---|
| Wool | 47.93 | 0.45 | −0.05 |
| Chlorinated Wool | 27.80 | 2.94 | −0.06 |

TABLE 31

Dyeing with precursors A and B (2 g/L $CH_3COONa$, pH 5.5, 100 μM PPT, MtL)

| | L* | a* | b* |
|---|---|---|---|
| Wool | 42.11 | 1.52 | −5.95 |
| Chlorinated Wool | 24.48 | 2.76 | −2.15 |

TABLE 32

Dyeing with precursors A and B (2 g/L $CH_3COONa$, pH 5.5, 100 μM methyl syringate, MtL)

| | L* | a* | b* |
|---|---|---|---|
| Wool | 47.83 | 0.99 | −0.14 |
| Chlorinated Wool | 25.77 | 3.37 | −0.99 |

The colorfastness to laundering (washfastness) for these swatches was evaluated using the American Association of Textile Chemist and Colorist (AATCC) Test Method 61-1989, 2A. The Launder-O-Meter was preheated to 49° C. and 200 ml 0.2% AATCC Standard Reference Detergent WOB (without optical brightener) and 50 steel balls were placed in each LOM beaker. The beakers were sealed and mounted in the LOM and run at 42 RPM for 2 minutes to preheat the beakers to the test temperature. The rotor was stopped and the beakers were unclamped. The swatches were added to the beakers and the LOM was run for 45 minutes. The beakers were removed and the swatches rinsed in hot tap water for 5 minutes, with occasional squeezing. The swatches were then dried at room temperature and evaluated by the Macbeth ColorEye 7000. A gray scale rating (1–5) was assigned to each swatch using the AATCC Evaluation Procedure 1, Gray Scale for Color Change. The results are given in

TABLE 33

Washfastness Results for precursors A and B (2 g/L $CH_3COONa$, pH 5.5, MtL)

| | L* | a* | b* | Gray Scale Rating |
|---|---|---|---|---|
| Wool | 50.59 | 1.11 | 7.07 | 3–4 |
| Chlorinated Wool | 31.74 | 2.83 | 7.09 | 3 |

TABLE 34

Washfastness results for precursors A and B (2 g/L $CH_3COONa$, pH 5.5, 100 μM PPT, MtL)

| | L* | a* | b* | Gray Scale Rating |
|---|---|---|---|---|
| Wool | 48.38 | −0.48 | 4.61 | 2–3 |
| Chlorinated Wool | 31.56 | 1.06 | 4.86 | 2 |

TABLE 35

Washfastness Results for precursors A and B (2 g/L $CH_3COONa$, pH 5.5, 100 μM methyl syringate, MtL)

| | L* | a* | b* | Gray Scale Rating |
|---|---|---|---|---|
| Wool | 52.02 | 0.06 | 6.59 | 3 |
| Chlorinated Wool | 32.17 | 2.02 | 6.08 | 2–3 |

The same experiment was repeated, except that a third compound (2-aminophenol, "C") and a fourth compound (m-phenylenediamine, "D") were used. The temperature used was 50° C. The results are given in Tables 36–41.

TABLE 36

Dyeing with precursors C and D (2 g/L $CH_3COONa$, pH 5.5, MtL)

| | L* | a* | b* |
|---|---|---|---|
| Wool | 53.52 | 5.92 | 18.19 |
| Chlorinated Wool | 47.79 | 4.73 | 17.08 |

TABLE 37

Dyeing with precursors C and D (2 g/L $CH_3COONa$, pH 5.5, 100 μM PPT, MtL)

| | L* | a* | b* |
|---|---|---|---|
| Wool | 52.38 | 6.70 | 21.84 |
| Chlorinated Wool | 46.86 | 5.55 | 17.87 |

TABLE 38

Dyeing with precursors C and D (2 g/L $CH_3COONa$, pH 5.5, 100 μM methyl syringate, MtL)

| | L* | a* | b* |
|---|---|---|---|
| Wool | 57.09 | 8.10 | 24.44 |
| Chlorinated Wool | 48.69 | 7.82 | 19.40 |

TABLE 39

| Washfastness Results for precursors C and D (2 g/L $CH_3COONa$, pH 5.5, MtL) | | | | |
|---|---|---|---|---|
| | L* | a* | b* | Gray Scale Rating |
| Wool | 57.38 | 7.23 | 10.97 | 3 |
| Chlorinated Wool | 51.35 | 7.04 | 13.16 | 3 |

TABLE 40

| Washfastness results for precursors C and D (2 g/L $CH_3COONa$, pH 5.5, 100 $\mu$M PPT, MtL) | | | | |
|---|---|---|---|---|
| | L* | a* | b* | Gray Scale Rating |
| Wool | 51.37 | 8.18 | 12.33 | 5 |
| Chlorinated Wool | 46.86 | 5.55 | 17.87 | 2 |

TABLE 41

| Washfastness Results for precursor C (2 g/L $CH_3COONa$, pH 5.5, 100 $\mu$M methyl syringate, MtL) | | | | |
|---|---|---|---|---|
| | L* | a* | b* | Gray Scale Rating |
| Wool | 59.61 | 7.24 | 11.89 | 4 |
| Chlorinated Wool | 50.01 | 7.94 | 14.38 | 4–5 |

The results from these two sets of experiments show that a mediator may be used for dyeing and for obtaining improved washfastness. In both experiments, worsted wool and chlorinated worsted wool were dyed at pH 5.5 in a $CH_3COONa$ buffer, in a $CH_3COONa$ buffer containing PPT, and in a $CH_3COONa$ buffer containing methyl syringate. However, a mediator resulted in improved washfastness only in the second experiment.

Example 10

Wool was dyed in an Atlas Launder-O-Meter ("LOM") at 30° C. for one hour at pH 5.5. The material dyed (obtained from Test Fabrics, Inc.) was worsted wool (Style 526, 8 cm×8 cm).

A 0.5 mg/ml solution of a first compound (p-phenylenediamine, "A") and a 0.5 mg/ml solution of a second compound (1-naphthol, "B") was prepared by dissolving the compound in the appropriate amount of 0.1 M $CH_3COONa$, pH 5.5, buffer. A total volume of 100 ml was used in each LOM beaker. 100 ml "A" was added to one beaker and 50 ml "A" and 50 ml "B" were combined to form 100 ml in a second beaker. Swatches of the material listed above were then wetted in DI water and soaked in the precursor solutions. A Coprinus cinereus peroxidase (CiP) with an activity of 180,000 POXU/ml was added to each beaker at a concentration of 0.05 POXU/ml. Either 200 or 500 $\mu$M hydrogen peroxide was added to each LOM beaker. The LOM beakers were sealed and mounted in the LOM. After 1 hour at 42 RPM and 30° C., the LOM was stopped. The spent liquor was poured off and the swatches were rinsed in cold tap water for about 15 minutes. The swatches were dried at room temperature and CIELAB values were measured for all of the swatches using the Macbeth Color-Eye 7000. The results are given in Tables 42–45.

TABLE 42

| Dyeing with precursor A, 200 $\mu$M $H_2O_2$ | | | |
|---|---|---|---|
| | L* | a* | b* |
| Wool | 54.84 | 1.70 | −2.18 |

TABLE 43

| Dyeing with precursor A, 500 $\mu$M $H_2O_2$ | | | |
|---|---|---|---|
| | L* | a* | b* |
| Wool | 43.58 | 2.50 | −4.62 |

TABLE 44

| Dyeing with precursors A and B, 200 $\mu$M $H_2O_2$ | | | |
|---|---|---|---|
| | L* | a* | b* |
| Wool | 56.19 | 2.60 | −9.44 |

TABLE 45

| Dyeing with precursors A and B, 500 $\mu$M $H_2O_2$ | | | |
|---|---|---|---|
| | L* | a* | b* |
| Wool | 50.48 | 4.14 | −11.68 |

The results show that wool can be dyed (purple shades with A and A/B) using precursor, peroxide and *Coprinus cinereus* (CiP) peroxidase.

Example 11

Chromed blue stock leather (Prime Tanning Corp., St. Joseph, Mo.) was dyed in a test tube at room temperature for 16 hours at pH 5, 7 and 9.

Three 0.5 mg/ml solutions of first compound (p-phenylenediamine, "A"), (pH 5, 7, and 9), three 0.5 mg/ml solutions of a second compound (1-naphthol, "B"), and three 0.5 mg/ml solutions of a third compound (4-hydroxycinnamic acid, "C") were prepared by dissolving each compound in the appropriate amount of 0.1 M Britten-Robinson Buffer (B-R buffer).

The leather substrate (1.5 cm×4 cm) was rolled up and placed in a four inch test tube. A total volume of 7 ml was used in each test tube. 6 ml of A (or 6 ml of C) was added to one test tube and 3 ml of A and 3 ml of B (or 3 ml of A and 3 ml of C) were combined to form 6 ml in a second test tube. A *Myceliophthora thermophila* laccase ("MtL") As with an activity of 690 LACU/ml (80 LACU/mg) was added to each beaker at a concentration of 2 LACU/ml (1 ml enzyme solution added to each test tube to give a total of 7 ml per test tube). The test tubes were closed, mixed and mounted on a test tube rotator. The test tubes were incubated for 16 hours in a dark cabinet at room temperature. After incubation, the swatches were rinsed in running cold tap water for 1 minute and dried at room temperature.

The results of the experiments are provided in Table 46:

TABLE 46

| FABRIC | PRECURSOR | pH 5 | pH 7 | pH 9 |
|---|---|---|---|---|
| Leather | A | Purple | Brown | Brown |
| Leather | A/B | Dark Purple | Purple | Purple |
| Leather | C | Light Green | Green | Green |
| Leather | A/C | Light Brown | Light Brown | Light Brown |

These results demonstrate that colorant forms on leather in the presence of *Myceliophthora thermophila* laccase and different types of precursors over a range of pH conditions.

Example 12

Silk was dyed in a test tube at ambient temperature for 16 hours at pH 5, 7 and 9. The material dyed (obtained from Test Fabrics, Inc.) was silk crepe de chine (Style 601, 1.5 cm×4 cm).

Three 0.5 mg/ml solutions of first compound (p-phenylenediamine, "A") (pH 5, 7, and 9) and three 0.5 mg/ml solutions of a second compound (1-naphthol, "B") were prepared by dissolving each compound in the appropriate amount of 0.1 M Britton-Robinson Buffer (B-R buffer).

The silk substrate was rolled up and placed in a four inch test tube. A total volume of 7 ml was used in each test tube. 6 ml of A was added to one test tube and 3 ml of A and 3 ml of B were combined to form 6 ml in a second test tube. A *Myceliophthora thermophila* laccase ("MtL") with an activity of 690 LACU/ml (80 LACU/mg) was added to each beaker at a concentration of 2 LACU/ml (1 ml enzyme solution added to each test tube to give a total of 7 ml per test tube). The test tubes were closed, mixed and mounted on a test tube rotator. The test tubes were incubated for 16 hours in a dark cabinet at room temperature. After incubation, the swatches were rinsed in running cold tap water for 1 minute and dried at room temperature.

The results of the experiments are provided in Table 47.

TABLE 47

| FABRIC | PRECURSOR | pH 5 | pH 7 | pH 9 |
|---|---|---|---|---|
| Silk | A | Dark Brown | Dark Brown | Dark Purple |
| Silk | A/B | Dark Brown | Dark Brown | Dark Brown |

These results demonstrate that colorant forms on silk in the presence of *Myceliophthora thermophila* laccase and different types of precursors over a range of pH conditions.

Example 13

A print paste is made by dissolving 5 mg/ml of paraphenylenediamine in 0.1 M sodium phosphate, pH 5.5, buffer and adding 2.5% gum arabic. The print paste is manually transferred to a wool fabric using a printing screen and a scraper. The portions of the fabric which are not to be printed are covered by a mask.

The fabric is then steamed for IO minutes in a steam chamber and allowed to dry.

Color is developed by dipping the fabric into a 2 LACU/ml laccase solution followed by a one hour incubation.

Example 14

A mono-, di- or polycyclic aromatic or heteroaromatic compound may be applied to the material by padding. For example, 0.5 mg/ml of p-phenylenediamine is dissolved in 500 ml of 0.1 M $K_2PO_4$, pH 7, buffer. A laccase is diluted in the same buffer. The p-phenylenediamine solution is padded on the material using a standard laboratory pad at 60° C. The fabric is steamed for 10 minutes. The steamed material may then be padded a second time with the enzyme solution. The dye is allowed to develop by incubating the swatches at 40° C. After incubation, the swatches are rinsed in running hot tap water for about 30 seconds.

What is claimed is:

1. A method of dyeing a material, comprising (a) soaking the material in an aqueous solution which comprises one or more naphthols, each of which is optionally substituted with one or more functional groups or substituents, wherein each functional group or substituent is selected from the group consisting of halogen; sulfo; sulfonato; sulfamino; sulfanyl; amino; aminophenyl; amido; amidophenyl; nitro; azo; inino; carboxy; cyano; formyl; hydroxy; halocarbonyl; carbamoyl; carbamidoyl; phosphonato; phosphonyl; $C_{1-18}$-alkyl; $C_{2-18}$-alkenyl; $C_{2-18}$-alkenyl: $C_{1-18}$-alkoxy; $C_{1-18}$-oxycarbonyl; $C_{1-18}$-oxoalkyl; $C_{1-18}$-alkyl sulfanyl; $C_{1-18}$-alkyl sulfonyl; and $C_{1-18}$-alkyl imino or amino which is substituted with one, two or three $C_{1-18}$-alkyl groups; wherein each $C_{1-18}$-alkyl, $C_{2-18}$-alkenyl and $C_{2-18}$-alkenyl group is optionally mono-, di or poly-substituted by any of the proceeding functional groups or substituents; and (b) treating the soaked material in an aqueous solution with (i) a hydrogen peroxide source and an enzyme exhibiting peroxidase or haloperoxidase activity or (ii) an enzyme selected from the group consisting of bilirubin oxidase, catechol oxidase, laccase, o-aminophenol oxidase, and polyphenol oxidase;

wherein the material is a fabric, yarn, fiber, garment or film made of fur, hide, leather, silk or wool.

2. The method according to claim 1, wherein the material is made of fur.

3. The method according to claim 1, wherein the material is made of hide.

4. The method according to claim 1, wherein the material is made of leather.

5. The method according to claim 1, wherein the material is made of silk.

6. The method according to claim 1, wherein the material is made of wool.

7. The method according to claim 1, wherein the material is dyed at a temperature in the range of about 5 to about 120° C.

8. The method according to claim 1, further comprising adding to the aqueous solution in step (b) a mono or divalent ion selected from the group consisting of sodium, potassium, calcium and magnesium ions.

9. The method according to claim 1, further comprising adding to the aqueous solution in step (b) a polymer selected from the group consisting of polyvinylpyrrolidone, polyvinylalcohol, polyaspartate, polyvinylamide, and polyethelene oxide.

10. The method according to claim 1, further comprising adding to the aqueous solution in step (b) an anionic, nonionic or cationic surfactant.

11. The method according to claim 1, wherein the material is dyed at a pH in the range of 2.5–12.

12. The method according to claim 1, further comprising adding to the aqueous solution in step (b) an agent which enhances the activity of the enzyme.

13. The method according to claim 1, wherein the aqueous solutions used in steps (a) and is (b) are the same.

14. The method according to claim 1, wherein said naphthol is selected from the group consisting of:

4,8-disulfonato-1-naphthol, 3-sulfonato-6-amino-1-naphthol (J acid), 6,8-disulfonato-2-naphthol, 1-Naphthol, 2-Naphthol, 4-Chloro-1-naphthol, 4,5-Dihydroxynapthalene-2,7-disulfonic acid (Chromotropic acid), 2-Amino-8-naphthol-6-sulfonic acid (Gamma acid), 5-Amino-1-naphthol-3-sulfonic acid (M acid), 2-Naphthol-3,6-disulfonic acid (R acid), 1-Amino-8-naphthol-2,4-disulfonic acid (Chicago acid), 1-Naphthol-4-sulfonic acid (Neville-Winther acid), N-Benzoyl J acid, N-Phenyl J acid, 3-hydroxy-2-naphthoic acid, azoic coupling compound 2 (CI 37505), Azoic Coupling Compound 20 (CI 37530), Azoic Coupling Compound 14 (CI 37558), Azoic Coupling Compound 21 (CI 37526), Azoic Coupling Compound 17 (CI 37515), Azoic Coupling Compound 18 (CI 37520), Mordant Black 3 (CI 146401), 4-Amino-5-hydroxy-2,6-naphthalene disulphonic acid (H acid), 1,5-Dihydroxynaphthalene, 2,6-Dihydroxynaphthalene, 2,3-Dihydroxynaphthalene, 6-Amino-2-naphthol, 3-Amino-2-naphthol, 5-Amino-1-naphthol, Acid Black 52 (CI 15711), Palantine Chrome Black 6BN (CI 157051), Mordant Black 11 (CI 14645), Acid Black 1 (CI 20470), Acid Red 176 (CI 16575), Acid Red 29 (CI 16570), Acid Red 14 (CI 14720) and 4-amino-5-hydroxy-1-naphthalenesulfonic acid (S acid).

* * * * *